US005631548A

United States Patent [19]

Susak

[11] Patent Number: 5,631,548

[45] Date of Patent: May 20, 1997

[54] POWER OFF-LOADING CIRCUIT AND METHOD FOR DISSIPATING POWER

[75] Inventor: David M. Susak, Phoenix, Ariz.

[73] Assignee: Motorola, Inc., Schaumburg, Ill.

[21] Appl. No.: 550,058

[22] Filed: Oct. 30, 1995

[51] Int. Cl.[6] ..... G05F 1/40

[52] U.S. Cl. ..... 323/273; 257/724

[58] Field of Search ..... 323/273; 361/18; 257/724

[56] References Cited

U.S. PATENT DOCUMENTS

| | | | |
|---|---|---|---|
| 3,919,601 | 11/1975 | Suko et al. | 323/273 |
| 4,599,555 | 7/1986 | Damiano et al. . | |
| 4,740,741 | 4/1988 | Andres et al. . | |
| 5,029,322 | 7/1991 | Einzinger et al. | 257/724 |
| 5,272,392 | 12/1993 | Wong et al. . | |
| 5,408,141 | 4/1995 | Devore et al. | 327/541 |
| 5,428,682 | 6/1995 | Apfel | 379/413 |

*Primary Examiner*—Stuart N. Hecker

*Attorney, Agent, or Firm*—Rennie William Dover

[57] ABSTRACT

A power off-loading circuit (10) includes an IC device (11) and a discrete resistor (21), which provide a regulated voltage at an output pin (19) of the IC device (11). The IC device (11) includes a first FET (12), a second FET (14), and an operational amplifier (16). For a low voltage at an input pin (13) of the IC device (11), the first FET (12) conducts a current to a load (25) connected to the output pin (19). For a high voltage at the input pin (13), a large portion of the current is directed through the discrete resistor (21) and the second FET (14). A large portion of power is off-loaded from the IC device (11) and dissipated in the discrete resistor (21) thereby permitting the use of surface mount techniques.

17 Claims, 1 Drawing Sheet

POWER OFF-LOADING CIRCUIT AND METHOD FOR DISSIPATING POWER

BACKGROUND OF THE INVENTION

The present invention relates, in general, to off-loading power from an integrated circuit device, and more particularly, to off-loading power by dissipating a portion of the power in a discrete device.

In integrated circuit applications, small surface mount packaging techniques are desirable because they provide a high packing density and a low cost alternative to large through-hole insertion packaging techniques. However, surface mount packages such as small outline integrated circuit (SOIC) packages cannot tolerate the high power dissipation required in some applications, e.g., automotive voltage regulators. Large drive current and large battery voltage excursions, which are common in automotive applications, require that the circuits have high power dissipation capabilities to accommodate the large voltage excursions.

Single in-line packaging (SIP) techniques are commonly used to meet the high power dissipation capability requirements. Compared with SOIC packages, SIPs are expensive and occupy large areas on circuit boards. Forced air cooling or liquid cooling also increase the power dissipation tolerance of a device, but they are expensive and inconvenient. Another technique for increasing the power dissipation capability of a voltage regulator includes using a switching power supply. However, the voltage output of a switching power supply is not smooth enough for many applications.

Accordingly, it would be advantageous to have a small surface mount packaged circuit that is capable of dissipating a large amount of power. It is also desirable for the circuit to be significantly less expensive than the circuits using packages such as SIPs.

DETAILED DESCRIPTION OF THE DRAWINGS

Figure 1:
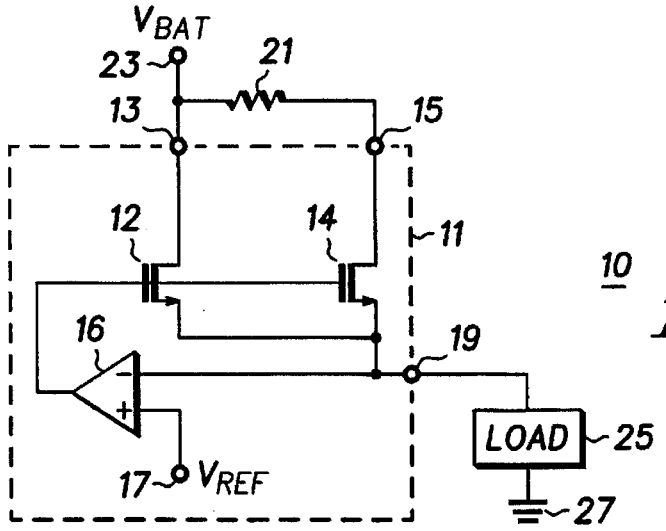
FIG. 1 is a schematic diagram of a power off-loading circuit in accordance with a first embodiment of the present invention.

FIG. 1 is a schematic diagram of a power off-loading circuit 10 in accordance with a first embodiment of the present invention. Power off-loading circuit 10 includes an integrated circuit device (IC device) 11 and a power dissipation resistor 21. Power dissipation resistor 21 is connected between an input pin 13 of IC device 11 and a power relief pin 15 of IC device 11. Power dissipation resistor 21 is a discrete device and has a high power dissipation tolerance. An output pin 19 of IC device 11 is coupled through a load 25 to a node 27. By way of example, node 27 is at a ground voltage level.

IC device 11 includes two metal oxide semiconductor field effect transistors (FETs) 12 and 14 and an operational amplifier 16. In a voltage regulator, an operational amplifier is also referred to as an error amplifier. A drain electrode of FET 12 is connected to input pin 13. A drain electrode of FET 14 is connected to power relief pin 15. A source electrode of FET 12, a source electrode of FET 14, and an inverting input of operational amplifier 16 are connected to output pin 19. A non-inverting input of operational amplifier 16 is connected to a node 17 for receiving a reference voltage level, $V_{ref}$. An output of operational amplifier 16 is connected to the gate electrodes of FETs 12 and 14. It should be understood that FET 12 and FET 14 are not limited to being metal oxide field effect transistors by the present invention. Any transistor having a control electrode and two current conducting electrodes can replace FETs 12 and 14. Because FET 12 and FET 14 form a current mirror, the two transistors are the same type of transistors.

IC device 11 and power dissipation resistor 21 form a voltage regulator. Input pin 13 is connected to node 23 for receiving an unregulated voltage level of a battery, $V_{bat}$. A feedback loop formed by operational amplifier 16 and FETs 12 and 14 adjusts the voltage at the inverting input of operational amplifier 16 to be equal to the voltage level at the non-inverting input of operational amplifier 16. Thus, the voltage level at output pin 19 is regulated to be equal to $V_{ref}$.

By way of example, $V_{ref}$ is 5 volts (V) and power dissipation resistor 21 has a resistance of 100 ohms (Ω). FET 14 is designed to have a current conducting capacity approximately nine times as large as that of FET 12. This is achieved by designing the ratio of the channel width to the channel length (W/L) of FET 14 to be nine times as high as the W/L ratio of FET 12. IC device 11 supplies a current of 100 milli-amperes (mA) to load 25.

If the unregulated voltage, $V_{bat}$, at node 23 is equal to 15 V, the voltage across input pin 13 and output pin 19 and thus the drain and source electrodes of FET 12 is 10 V. Because of their respective current conducting capabilities, FET 12 is conducting a current of 10 mA and FET 14 is conducting a current of 90 mA. Thus, the power dissipation of FET 12 is equal to 100 milli-watts (mW). Power dissipation resistor 21 is also conducting a current of 90 mA because power dissipation resistor 21 is connected in series with the drain and source electrodes of FET 14. Therefore, the voltage across power dissipation resistor 21 is 9 V and the power dissipation of power dissipation resistor 21 is 810 mW. The voltage across power relief pin 15 and output pin 19 is equal to 1 V and the power dissipation of FET 14 is equal to 90 mW. Therefore, the total power dissipation of IC device 11 is 190 mW. For comparison, a voltage regulator without power dissipation resistor 21 dissipates 1 watt of power under the same conditions. However, a 1 watt power dissipation is unacceptable for a device packaged in an SOIC package. In accordance with the present invention, a small current is directed to FET 12, which operates at a high voltage, and a large current is directed to FET 14, which operates at a low voltage. Thus, a portion of the power is off-loaded from IC device 11 to power dissipation resistor 21. As a result, the power dissipation of IC device 11 is low enough to allow IC device 11 to be mounted to a circuit board using surface mounting techniques.

If the unregulated voltage at node 23 decreases to, for example, 6 V, the voltage across input pin 13 and output pin 19 is equal to 1 V. Because power dissipation resistor 21 and FET 14 share the voltage across input pin 13 and output pin 19, the voltage across the drain and source electrodes of FET 14 is lower than 1 V when current flows through power dissipation resistor 21 and FET 14. FET 14 is now in a linear region and conducting a small current. Thus, FET 12 conducts most of the current supplied by IC device 11 to load 25. When FET 12 conducts a current of 100 mA, FET 12 dissipates 100 mW of power.

Figure 2:
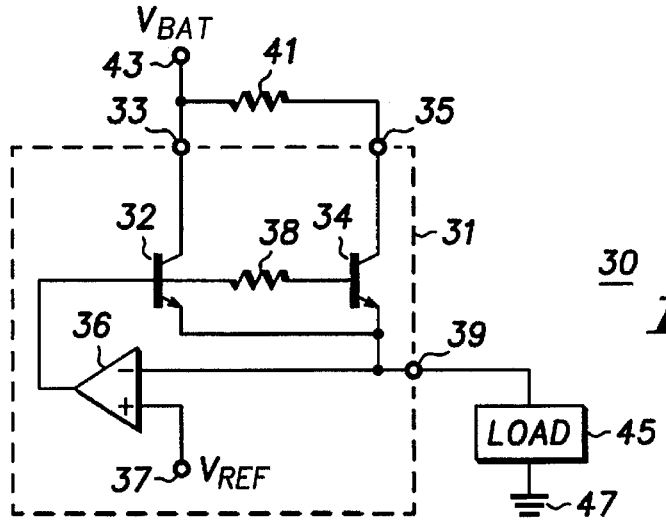
FIG. 2 is a schematic diagram of a power off-loading circuit in accordance with a second embodiment of the present invention.

FIG. 2 is a schematic diagram of a power off-loading circuit 30 in accordance with a second embodiment of the present invention. Power off-loading circuit 30 includes an IC device 31 and a power dissipation resistor 41. Power dissipation resistor 41 is a discrete device that is connected between an input pin 33 of IC device 31 and a power relief pin 35 of IC device 31. An output pin 39 of IC device 31 is coupled through a load 45 to a node 47. By way of example, node 47 is at a ground voltage level.

IC device 31 includes two bipolar transistors 32 and 34 and an operational amplifier 36. A collector electrode of transistor 32 is connected to input pin 33. A collector electrode of transistor 34 is connected to power relief pin 35. An emitter electrode of transistor 32, an emitter electrode of transistor 34, and an inverting input of operational amplifier 36 are connected to output pin 39. A non-inverting input of operational amplifier 36 is connected to a node 37 for receiving a reference voltage level, $V_{ref}$. An output of operational amplifier 36 is connected to a base electrode of transistor 32. A first electrode of a base resistor 38 is connected to the base electrode of transistor 32 and a second electrode of base resistor 38 is connected to a base electrode of transistor 34.

IC device 31 and power dissipation resistor 41 form a voltage regulator. Input pin 33 is connected to node 43 for receiving an input signal such as, for example, an unregulated voltage level of a battery, $V_{bat}$. A feedback loop formed by operational amplifier 36 and transistors 32 and 34 adjusts the voltage at the inverting input of operational amplifier 36 to be equal to the voltage level at the non-inverting input of operational amplifier 36. Thus, the voltage level at output pin 39 is regulated to be equal to $V_{ref}$.

By way of example, $V_{ref}$ is 10 V and IC device 31 supplies a current of 200 mA to load 45. Transistor 34 is designed to have a current conducting capacity approximately nine times as large as that of transistor 32. This is achieved by designing the emitter area of transistor 34 to be nine times as large as that of transistor 32. Power dissipation resistor 41 has a resistance of 25Ω.

If the unregulated voltage, $V_{bat}$, at node 43 is equal to 15 V, the voltage across input pin 33 and output pin 39 and thus across the collector and emitter electrodes of transistor 32 is 5 V. Because of their respective current conducting capabilities, transistor 32 is conducting a current of 20 mA and transistor 34 is conducting a current of 180 mA. Thus, the power dissipation of transistor 32 is equal to 100 mW. Power dissipation resistor 41 is also conducting a current of 180 mA because power dissipation resistor 41 is connected in series with the collector and emitter electrodes of transistor 34. Therefore, the voltage across power dissipation resistor 41 is 4.5 V, and the power dissipation of power dissipation resistor 41 is 810 mW. The voltage across power relief pin 35 and output pin 39 is equal to 0.5 V and the power dissipation of transistor 34 is equal to 90 mW. Therefore, the total power dissipation of IC device 31 is 190 mW. For comparison, a voltage regulator without power dissipation resistor 41 dissipates 1 watt of power under the same condition. However, a 1 watt power dissipation is unacceptable for a device packaged in an SOIC package. In accordance with the present invention, a small current is directed to transistor 32, which operates at a high voltage, and a large current is directed to transistor 34, which operates at a low voltage. As a result, a portion of the power is off-loaded from IC device 31 to power dissipation resistor 41.

If the unregulated voltage at node 43 decrease to, for example, 11 V, the voltage across input pin 33 and output pin 39 is equal to 1 V. Because power dissipation resistor 41 and transistor 34 share the voltage across input pin 33 and output pin 39, the voltage across the collector and emitter electrodes of transistor 34 is lower than 1 V when current flows through power dissipation resistor 41 and transistor 34. It should be noted that transistor 34 may enter a saturation region and inject a small current into the substrate of IC device 31. To prevent the injection of current into the substrate, base resistor 38 is used to adjust the voltage level at the base electrode of transistor 34 and switch off transistor 34. To further limit current injection into the substrate, transistor 34 may include a second emitter (not shown in FIG. 2) which is connected to its base electrode. As a result, transistor 34 is limited to entering a soft saturation region when the voltage across its collector and emitter electrodes decreases below a voltage level required for the linear operation of transistor 34. Alternatively, a p-ring can be built in an n-epitaxial layer of transistor 34. The p-ring is then connected to the emitter electrode of transistor 34. In each current injection suppression technique, when the voltage across input pin 33 and output pin 39 is below a voltage level required for transistor 34 to operate in the linear region, transistor 32 conducts most of the current supplied by IC device 31 to load 45. When transistor 32 conducts a current of 200 mA, transistor 32 dissipates 200 mW of power.

Figure 3:
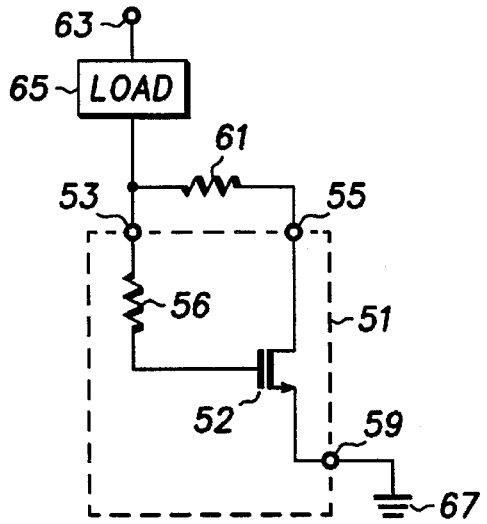
FIG. 3 is a schematic diagram of a power off-loading circuit in accordance with a third embodiment of the present invention.

FIG. 3 is a schematic diagram of a power off-loading circuit 50 in accordance with a third embodiment of the present invention. Power off-loading circuit 50 includes an IC device 51 and a power dissipation resistor 61. Power dissipation resistor 61 is connected between an input pin 53 of IC device 51 and a power relief pin 55 of IC device 51. An output pin 59 of IC device 11 is connected to a node 67. A load 65 is coupled between input pin 53 of IC device 51 and a node 63. By way of example, node 63 is at a supply voltage level and node 67 is at a ground voltage level.

IC device 51 includes a metal oxide semiconductor FET 52 and a resistor 56. A drain electrode of FET 52 is connected to power relief pin 55. A source electrode of FET 52 is connected to output pin 59. A gate electrode of FET 52 is coupled to input pin 53 via resistor 56. It should be understood that FET 52 is not limited to being a metal oxide field effect transistor by the present invention. Any transistor having a control electrode and two current conducting electrodes can replace FET 52.

In operation, IC device 51 and power dissipation resistor 61 complete a current path for load 65 when a charge path through resistor 56 raises the gate-source voltage of FET 52 above the threshold voltage of FET 52. By way of example, power dissipation resistor 61 has a resistance of 90Ω, load 65 conducts a current of 100 mA, and the voltage across input pin 53 and output pin 59 is 10 V. Therefore, the voltage across power dissipation resistor 61 is 9 V, resulting in resistor 61 dissipating 900 mW of power. The voltage across power relief pin 55 and output pin 59 is equal to 1 V and the current flowing in IC device 51 is 100 mA; thus the power dissipated by IC device 51 is 100 mW. For comparison, an IC device without power dissipation resistor 61 dissipates 1 watt of power under the same conditions, which is unacceptable for a device packaged in an SOIC package. In accordance with the present invention, a portion of power is off-loaded from IC device 51 to power dissipation resistor 61.

By now it should be appreciated that a method for off-loading power from an integrated circuit and a power off-loading circuit have been provided. The present invention enables a small surface mount packaged circuit to dissipate a large amount of power, e.g., a power greater than 400 mW, without additional cooling mechanisms such as forced air cooling or liquid cooling. A circuit in accordance with the present invention is significantly less expensive than the circuits using other packages such as SIPs.

I claim:

1. A power off-loading circuit, comprising:

an integrated circuit device having an input pin, a power relief pin, and an output pin, wherein the integrated circuit device includes a switch having a first current conducting electrode coupled to the output pin and a second current conducting electrode coupled to power relief pin; and a power dissipation resistor having a first electrode coupled to the input pin of the integrated circuit device and a second electrode coupled to the power relief pin of the integrated circuit device.

2. The power off-loading circuit of claim 1, wherein the integrated circuit device is surface mounted on a circuit board.

3. The power off-loading circuit of claim 1, wherein the power dissipation resistor is a discrete device that is surface mounted on a circuit board.

4. The power off-loading circuit of claim 1, wherein the switch has a control electrode, and wherein the integrated circuit device further includes a resistor having a first electrode coupled to the input pin of the integrated circuit device and a second electrode coupled to the control electrode of the switch.

5. The power off-loading circuit of claim 4, wherein the switch is an n-channel metal oxide semiconductor field effect transistor.

6. The power off-loading circuit of claim 1, wherein the switch has a control electrode, and wherein the integrated circuit device further includes:

a transistor having a control electrode coupled to the control electrode of the switch, a first current conducting electrode coupled to the output pin of the integrated circuit device, and a second current conducting electrode coupled to the input pin of the integrated circuit device; and an operational amplifier having a non-inverting input coupled for receiving a reference voltage, an inverting input coupled to the first current conducting electrode of the transistor, and an output coupled to the control electrode of the transistor.

7. The power-off loading circuit of claim 6, wherein the switch and the transistor are metal oxide semiconductor field effect transistors.

8. The power-off loading circuit of claim 6, wherein the switch and the transistor are bipolar transistors.

9. The power off-loading circuit of claim 8, wherein the control electrode of the transistor is coupled to the control electrode of the switch via a base resistor, wherein the base resistor has a first electrode coupled to the control electrode of the transistor and a second electrode coupled to the control electrode of the switch.

10. A power off-loading voltage regulator, comprising:

an integrated circuit device having an input pin, a power relief pin, and an output pin coupled for receiving a first reference voltage, wherein the integrated circuit device includes:

a first transistor of having a control electrode, a first current conducting electrode, and a second current conducting electrode, wherein the first current conducting electrode is coupled to the output pin of the integrated circuit device and the second current conducting electrode is coupled to the input pin of the integrated circuit device;

a second transistor having a control electrode, a first current conducting electrode, and a second current conducting electrode, wherein the control electrode is coupled to the control electrode of the first transistor, the first current conducting electrode is coupled to the first current conducting electrode of the first transistor, and the second current conducting electrode is coupled to the power relief pin of the integrated circuit device; and an error amplifier having a non-inverting input, an inverting input, and an output, wherein the non-inverting input is coupled for receiving a second reference voltage, the inverting input is coupled to the first current conducting electrode of the first transistor, and the output is coupled to the control electrode of the first transistor; and a resistor having a first electrode and a second electrode, wherein the first electrode is coupled to the input pin of the integrated circuit device and the second electrode is coupled to the power relief pin of the integrated circuit device.

11. The power off-loading voltage regulator of claim 10, wherein the integrated circuit device is surface mounted on a circuit board.

12. The power off-loading voltage regulator of claim 10, wherein the input pin is coupled for receiving an unregulated voltage signal relative to the first reference voltage and the output pin is coupled for providing a regulated voltage signal relative to the first reference voltage.

13. The power off-loading voltage regulator of claim 10, wherein the first transistor and the second transistor are metal oxide semiconductor field effect transistors.

14. The power off-loading voltage regulator of claim 10, wherein the first transistor and the second transistor are bipolar transistors.

15. The power off-loading voltage regulator of claim 14, wherein the control electrode of the second transistor is coupled to the control electrode of the first transistor via a base resistor, wherein the base resistor has a first electrode coupled to the control electrode of the first transistor and a second electrode coupled to the control electrode of the second transistor.

16. A method for dissipating power, comprising the steps of:

providing an integrated circuit device;

providing a dissipation resistor;

generating a first voltage across a first pin and a second pin of the integrated circuit device;

passing a first current from the first pin to the second pin of the integrated circuit device through a first conduction path in the integrated circuit device; and shunting a portion of the first current from the first pin to the second pin of the integrated circuit device through the dissipation resistor, a relief pin of the integrated circuit device, and a second conduction path in the integrated circuit device in response to the first voltage exceeding a predetermined voltage, the second conduction path being different from the first conduction path.

17. The method for dissipating power as claimed in claim 16, further comprising the step of generating a second voltage relative to a reference voltage level at the second pin of the integrated circuit device.

* * * * *